US005193048A

United States Patent [19]

Kaufman et al.

[11] Patent Number: 5,193,048

[45] Date of Patent: Mar. 9, 1993

[54] STUN GUN WITH LOW BATTERY INDICATOR AND SHUTOFF TIMER

[76] Inventors: Dennis R. Kaufman, 5508 Suttan La. #A, Willoughby, Ohio 44094; William A. Keeley, 1951 N. Baldwin Rd., Oxford, Mich. 48051

[21] Appl. No.: 516,120

[22] Filed: Apr. 27, 1990

[51] Int. Cl.[5] ..... H05C 1/04

[52] U.S. Cl. ..... 361/232; 273/84 ES

[58] Field of Search ..... 361/232; 231/7; 273/84 ES; 89/1.11; 43/98; 200/52 R, 543, 334, 43.04, 43.05

[56] References Cited

U.S. PATENT DOCUMENTS

| | | | |
|---|---|---|---|
| 3,724,744 | 4/1973 | Carnahan | 231/7 |
| 3,803,463 | 4/1974 | Cover | 361/232 |
| 3,819,108 | 6/1974 | Jordan | 231/7 |
| 3,885,733 | 5/1975 | Klebold et al. | 231/7 |
| 3,917,268 | 11/1975 | Tingey et al. | 273/84 ES |
| 3,998,459 | 12/1976 | Henderson et al. | 273/84 ES |
| 4,037,683 | 7/1977 | LeBell | 180/99 |
| 4,092,695 | 5/1978 | Henderson et al. | 361/232 |
| 4,162,515 | 7/1979 | Henderson et al. | 361/232 |
| 4,253,132 | 2/1981 | Cover | 361/232 |
| 4,424,932 | 1/1984 | Allen | 231/7 |
| 4,486,807 | 12/1984 | Yanez | 361/232 |
| 4,502,030 | 2/1985 | Caruso | 335/164 |
| 4,688,140 | 8/1987 | Hammes | 361/232 |
| 4,872,084 | 10/1989 | Dunning et al. | 361/232 |

*Primary Examiner*—A. D. Pellinen
*Assistant Examiner*—David Osborn
*Attorney, Agent, or Firm*—Fay, Sharpe, Beall, Fagan, Minnich & McKee

[57] ABSTRACT

A hand-held contact shock producing and nonlethal stun device wherein the electrical circuitry therein includes an oscillator coupled to an inverter transformer which, in turn, cooperates with an output transformer and spark gap device to produce a high voltage, short duration, low current arc across contact probes. The internal circuitry further includes a low battery detection circuit wherein a visual display of a low battery condition is produced when the gun is activated for a first predetermined time period. To preclude overzealous application of the device, the oscillator is disabled after a second predetermined time period. A wrist strap secured to the operator and having a key portion fixedly attached thereto is also provided. The key portion is received into the device housing and closes a kill switch within the housing to disable the device when removed from the housing. The key portion remaining with the operator disables the circuit when the device is separated from the operator. The key portion further provides means for re-enabling the device if recovered by the operator.

42 Claims, 4 Drawing Sheets

STUN GUN WITH LOW BATTERY INDICATOR AND SHUTOFF TIMER

BACKGROUND OF THE INVENTION

1. Field of the Invention

The present invention relates to an electronic device designed to incapacitate a person by means of non-lethal electric shock. More particularly, the present invention relates to a hand-held stun gun used by law enforcement officers to affect the neuromuscular system of the body by interrupting electrical nerve impulses, causing a mild state of confusion or disorientation.

2. Description of the Prior Art

In general, the term "stun gun" has been generically applied to any electronic device designed to incapacitate a person by means of non-lethal technology. Most stun guns have a hardened and nonconductive exterior case in which is housed the electronic circuitry. Generally protruding from the case are preferably two or four probes through which a high voltage, low duration, and low charge pulse, produced by the internal circuitry, is delivered. An example of such a device is disclosed in U.S. Pat. No. 4,872,084 issued to Dunning, et al. for "Enhanced Electrical Shocking Device with Improved Long Life and Increased Power Circuitry" ("'084 Patent").

The disclosure in the '084 Patent describes a stun gun which utilizes a pair of surge arresters in place of the conventional internal spark gap found in most stun guns. The pair of surge arresters are used to eliminate the problems associated with the corrosion and pitting of the internal spark gap which made prior art stun guns unreliable. Also disclosed in the '084 Patent is a strap attached to the stun gun housing such that when in use, the user's fingers are wrapped around grooves in the housing and the strap is wrapped around the back of the user's hand. If the stun gun is knocked out of the user's hand by an assailant, the force of the stun gun "flying out of the user's hand" creates a pulling effect on a pin connected from the strap to an ON-OFF switch, causing the switch to open and break contact, thereby deactivating the stun gun temporarily. Reinsertion of the strap end back into the stun gun housing serves to reactivate the device.

The electronic circuitry within the housing of the '084 Patent utilizes an inverter transformer and an output transformer to generate the high voltage at the contact probes. The inverter transformer is driven by a standard relaxation oscillator circuit which is activated upon closure of a trigger switch. The secondary winding of the inverter transformer is used to drive a half wave rectifier circuit to charge a large storage capacitor. The storage capacitor continues to charge until a point when the voltage across a series pair of surge arresters reaches a "breakover" point, at which time the storage capacitor discharges through the primary windings of the output transformer. The output transformer, having a turns ratio selected to step up the applied voltage, produces approximately 75,000 volts across the contact probes attached to the secondary winding. The circuit thus operates to produce the high voltage for so long as the trigger switch is operated.

Therefore, there exists a need for a stun gun device having a low battery indicator light to alert an operator that the battery driving the internal electronic circuits have reached the end of their useful life. Further, the market demands a stun gun having a fail-safe shutdown feature wherein an overzealous operator is precluded from applying the device against a victim for prolonged periods. The market further demands a stun gun which is deactivated if stripped away from an officer and which is rendered useless to an assailant who may obtain possession of the device without a reactivation component securely strapped about the operators wrist or to his person. Lastly, the market demands the efficient utilization of energy stored in the battery power source to permit the device to be used for prolonged periods.

SUMMARY OF THE INVENTION

In accordance with the present invention there is provided an improved stun gun or electrical shock device which includes a low battery indicator light, a shutdown timer, a deactivation or kill switch feature which prevents use of the device against an operator by an assailant, and an improved output circuit having a "tuned" output impedance.

In accordance with the invention, a stun gun of the general type described is provided where the oscillator circuit used to drive the primary winding of the inverter transformer is provided with a first and second associated circuit to disable the oscillator upon preselected condition. In particular, a timer circuit is provided to toll the period of continuous use of the oscillator. Upon completion of a predetermined time period, the timing circuit serves to disable the oscillator to reduce the chance of unintentional abuse of a suspect/subject due to overzealous device application. The oscillator will, in turn, be re-enabled after a second predetermined time set in the timer circuit.

The present invention further includes an internal kill switch which also functions to disable the oscillator circuit when a "key" is removed from the device housing. The key is designed to connect to a wrist strap or other means for attachment to an operator wherein separation of the device from the operator causes the key to detach from the device housing and thus open a kill switch. Since the key is attached to a wrist strap or other tether-type strap fastened to an operator's person, the device is rendered useless to anyone who may control the device without the requisite key component.

The present invention further includes a low battery indicator light in the form of an LED. Since an operator must rely upon the energy stored in the batteries to drive the electronics of the device, it is critical that an operator be alerted of a low battery condition. The housing of the present invention is formed with a small aperture through which the LED indicating light may be viewed.

It is therefore an object of the present invention to provide a stun gun or electrical shock device which adds improved safety features to the prior art stun gun devices.

It is another object of the present invention to provide a stun gun which alerts an operator to a low battery condition, thus precluding a failure of the device in the field when it is most needed due to old or stale batteries.

It is a further object of the present invention to provide a stun gun with a built in shutoff feature wherein each time the activator switch is pressed continually for 15 seconds, the stun gun circuitry automatically disables for a predetermined time. Upon continuous application of the activator switch, the electronics within the housing will reactivate for another 15 seconds of continuous use, thus repeating the cycle.

It is still further an object of the present invention to provide a stun gun equipped with a wrist strap which serves to protect an operator against unwarranted use by an assailant who strips the device from the operator. Should the device be separated from the operator, a key, attached to the wrist strap is detached from the device housing thus disabling the stun gun device. The stun gun of the present invention may be re-enabled upon reinsertion of the key into the device housing. However, the key remains with the operator attached to his person, rather than to the device itself.

It is still further an object of the present invention to provide a stun gun efficient in the use of energy stored in the batteries through an efficient output circuit having a low output impedance.

BRIEF DESCRIPTION OF THE DRAWINGS

The invention may take physical form in certain parts and arrangement of parts, a preferred embodiment which will be described in detail in the specification and illustrated in the accompanying drawings which form a part hereof and wherein.

DETAILED DESCRIPTION OF THE PREFERRED EMBODIMENT

Figure 1:
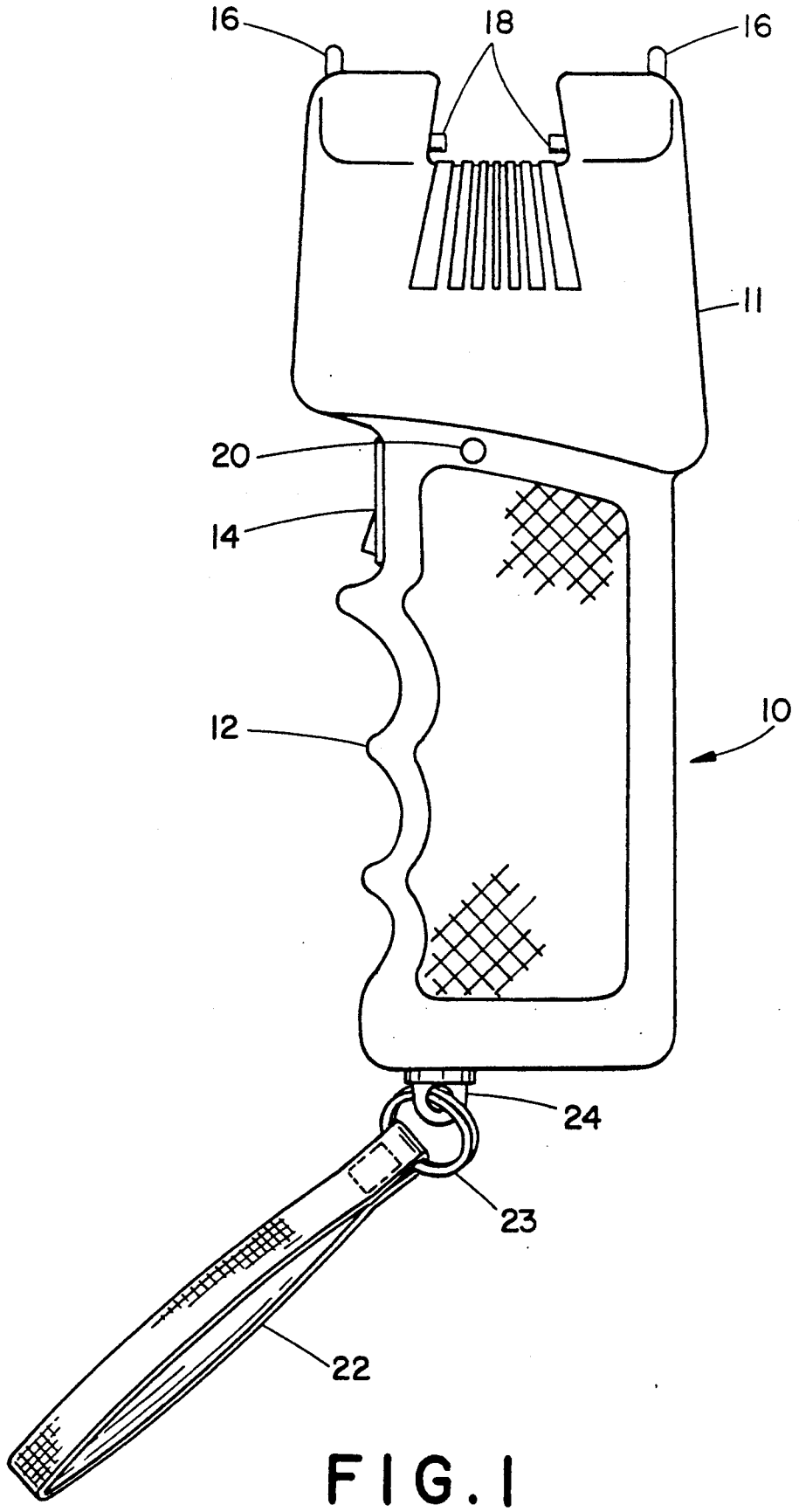
FIG. 1 is a side view of the present invention stun gun showing its wrist strap and low battery indicator light.

Referring now to the drawings, wherein the showings are for the purposes of illustrating the preferred embodiment of the invention only and not for purposes of limiting same, the FIGURES show the enhanced stun gun of the present invention.

Referring first to FIG. 1, the present invention stun gun is shown as 10 and is comprised of a housing 11 having a pistol grip 12 and a trigger switch 14. The trigger switch 14 is located at a position on the housing 11 situated to receive an operator's index finger. Extending from the housing 11 are a pair of contact probes 16 and test probes 18, the pair of contact probes 16 being used to apply the high voltage generated within the housing 11 to an assailant/victim. The housing 11 is provided with an aperture 20 through which the low battery indicator LED may be viewed. At the lower end of housing 11, is a wrist strap 22, through which extends an operator's wrist while gripping the pistol grip 12. As shown in the FIGURE, a ring 23 connects the wrist strap 22 with the key 24, the key 24 shown in its engaged/attached position. As may be apparent to one skilled in the art, other means may be used to attach the key 24 to an operator's person, such as a tether from the ring 23 to an operator's belt loop, shoulder holster, or waist holster.

Figure 2:
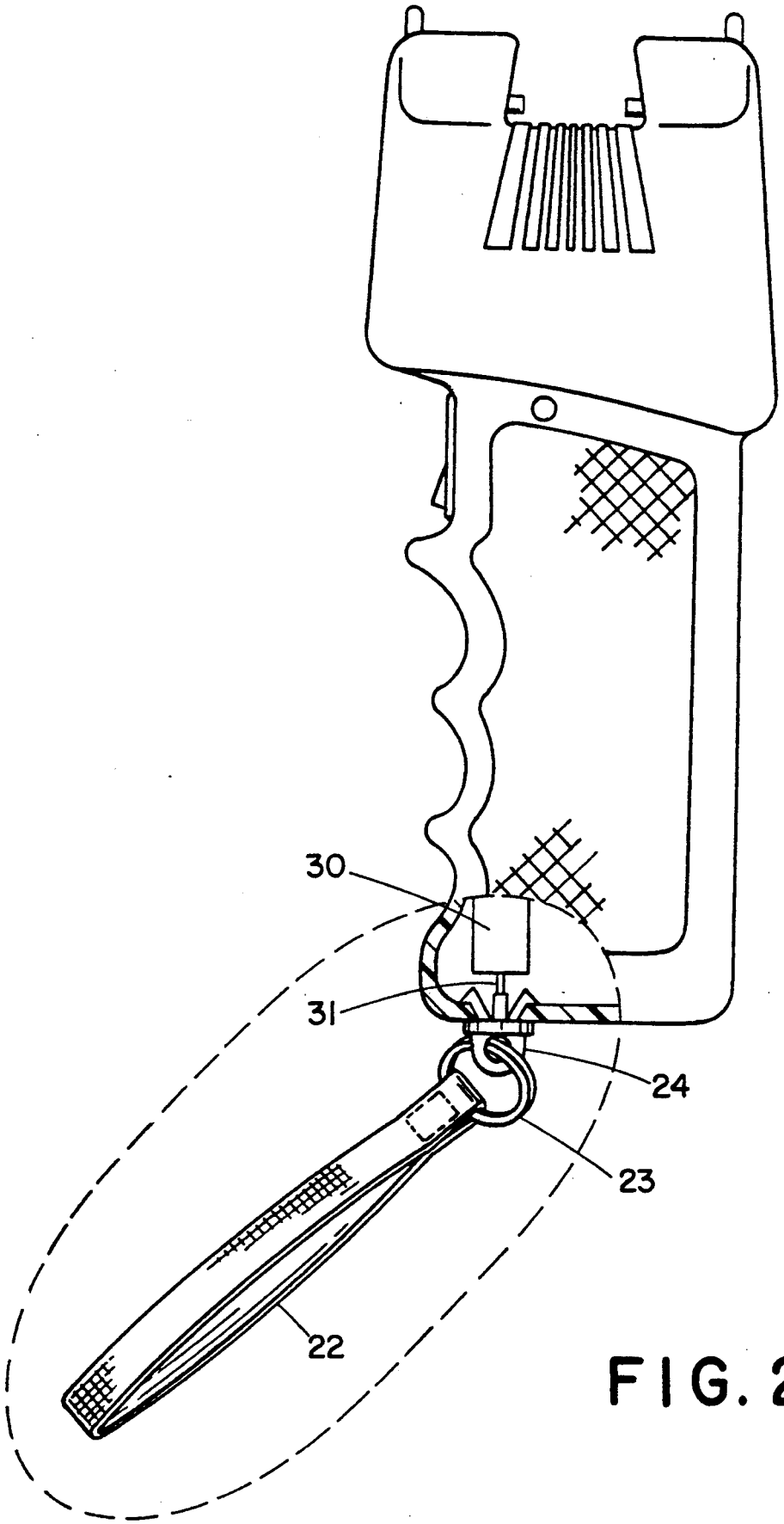
FIG. 2 is a side view and partial cut-away of the present invention stun gun, showing its disable switch and key components attached to the wrist strap.

Referring now to FIG. 2, a portion of the housing 11 is shown cut-away. The key 24 is shown received into the housing 11 and in contact with plunger 31 of switch 30. The switch 30 is fixed mechanically to a circuit board contained within the housing and not shown in detail.

Figure 3:
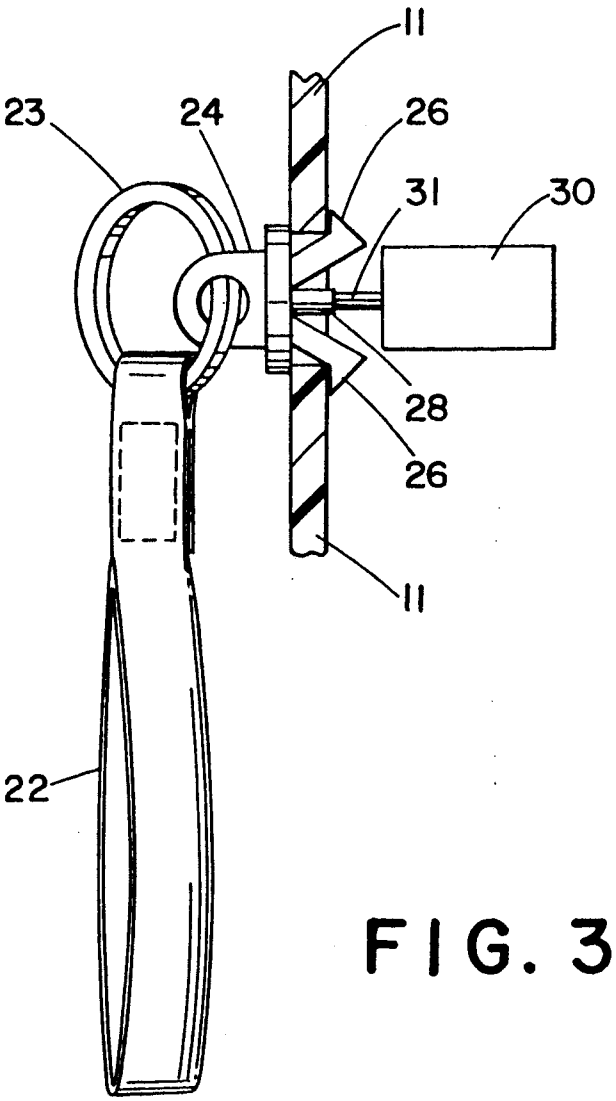
FIG. 3 is an enlarged view of the dashed portion of FIG. 2, wherein the key portion is received into the device housing.

FIG. 3 is an enlarged view of the cut-away portion of FIG. 2 showing the key 24 received into the housing 11. As can be seen from the FIGURE, key 24 is comprised of a pair of barbed, springy legs 26 which, when inserted into the housing 11, serve to "lock" the key 24 therein. The key 24 is also provided with a centrally located fixed plunger 28 arranged to make contact with and slidably actuate plunger 31 of switch 30. The key 24 may be made of a relatively durable plastic such that upon insertion into the housing 11, removal may be accomplished only upon application of a predetermined force on ring 23. The material and dimensions of ring 24 should be selected such that a substantial force should be required to dislodge the key 24 from housing 11.

Figure 4:
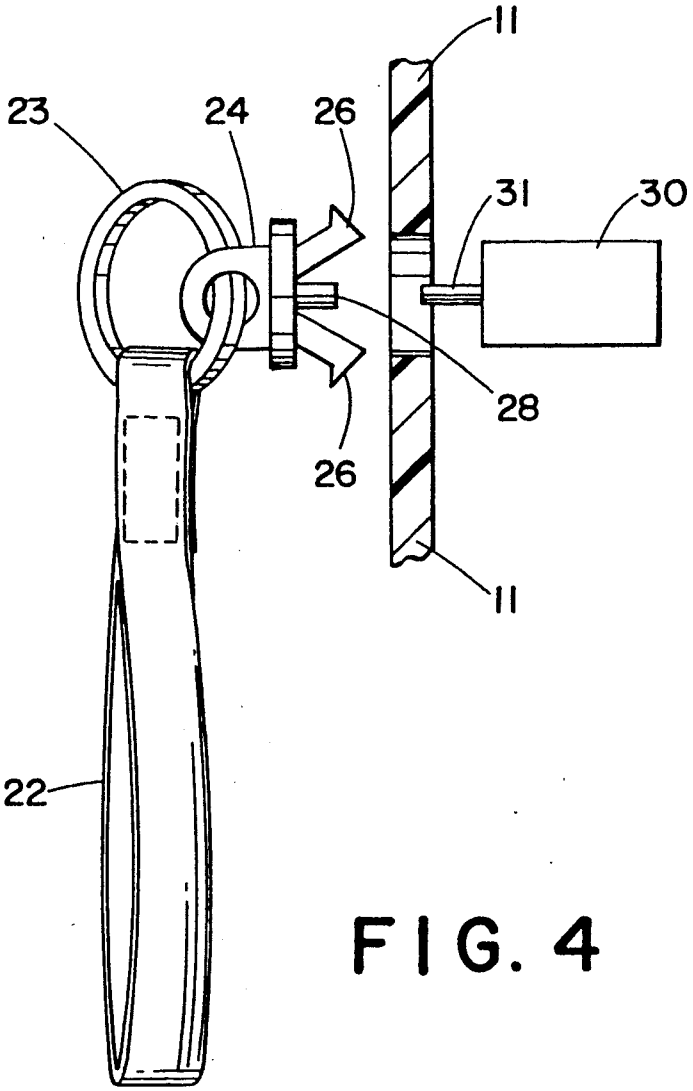
FIG. 4 is an enlarged view of the dashed portion of FIG. 2, wherein the key portion is shown detached from the device housing; and, FIG. 5 is a circuit diagram of the improved electronic circuitry of the present invention.

Referring next to FIG. 4, wherein the cut-away portion of FIG. 2 is shown in an enlarged view, the key 24 is shown detached from housing 11. As seen in the FIGURE, the spring loaded plunger 31 of switch 30 is permitted to slidably extend into its unactuated position in the absence of key 24 and associated centrally located fixed plunger 28. The FIGURE shows the pair of barbed, springy legs 26 in their unsprung position and ready for reinsertion into the housing 11 to re-enable the stun gun device upon actuation of plunger 31 into switch 30.

Figure 5:
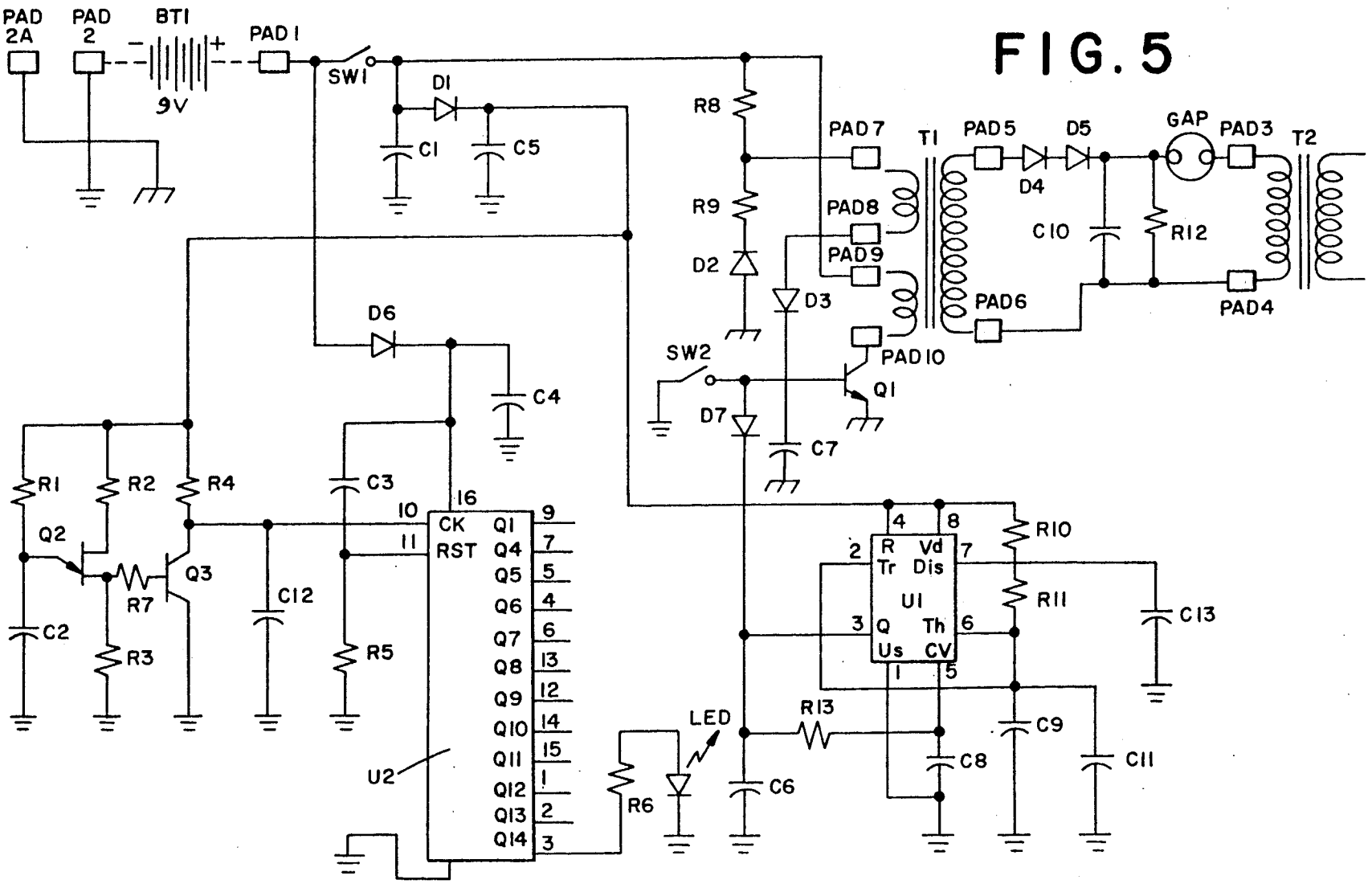

Referring now to FIG. 5, a circuit diagram of the improved electronic circuitry of the present invention is shown. Power is supplied to the circuit from a battery source BTl. The electrical diagrammatic representation of trigger switch 14 is shown as switch SWl, wherein closure of the switch SWl connects power source BTI with the inverter transformer TI. In general, a classic relaxation oscillator is formed using a "tickler" winding of inverter transformer T1 shown between the terminals PAD7 and PAD8. The primary winding of the inverter transformer T1 is shown in the FIGURE having connections at PAD9 and PAD10. Upon closure of the power switch SW1, the primary winding of inverter transformer T1 is energized as current flows through the winding from PAD9 to PAD10 as the power transistor Q1 conducts. The tickler winding of inverter transformer T1 is energized upon closure of the power switch SWI through resistor R8 and diode D3. The current through the tickler winding also forms the base current of power transistor Q1, thus causing it to conduct. Since the tickler winding and the primary winding of the inverter transformer T1 oppose one another, the current through power transistor Q1 causes a flux in the inverter transformer T1 to, in effect, backdrive the tickler winding and cut off the power transistor Q1 base current, thus forming the relaxation oscillator.

The output circuit of the stun gun of the present invention is shown in FIG. 5 as consisting of the secondary winding of inverter transformer Tl, a pair of diodes D4 and D5, serially connected with a spark gap device GAP and the primary winding of output transformer T2. A storage capacitor C10 is shown in parallel with bleeder resistor R12 and the primary winding of the output transformer T2. The bleeder resistor R12 is provided to discharge the storage capacitor at a slow rate to prevent accidental discharge of the device once power has been removed.

The spark gap device GAP is selected to have particular ionization characteristics tailored to a specific spark gap breakover voltage to "tune" the output circuit. The spark gap device GAP is filled with an inert gas such as argon, having a well defined and generally stable permittivity constant to ensure predictability of the spark gap breakover point voltage. In the preferred embodiment, the output transformer T2 is formed having a 26:1080 turns ratio with a primary winding resistance of 0.04 ohms and a secondary resistance of 108 ohms. One commercially available output transformer Tl is formed having a trade number 4077375411 ferrite core, having the trademark "FAIR RITE", manufactured by Fair-Rite Products Corp., Wallkill, New York.

Technical evaluation of the circuit of the present invention shows that the electrical output waveform of the device is a repeating damped sinusoid with a repetition rate of approximately 20 pulses per second. The principle frequency component of the sinusoid is approximately 1 MHz. Using the above-described combination of spark gap device and output transformer, the peak voltage present at the electrodes when the output is connected to a resistive load which drops the unloaded voltage to half is approximately 50,000 volts. This measure of source impedance is about half that of similar stun guns on the market today. The physiological effect of this reduced source impedance is to increase the magnitude of the electrical current impulses or energy delivered to a subject/victim and thereby increase the effectiveness of the stun gun in practical application.

With continued reference to FIG. 5, the low battery indicator feature of the present invention is shown. A 14 stage ripple carry counter U2 receives power from power source BTI through diode D6. A charge is stored on capacitor C4 to provide power to the 14 stage ripple carry counter U2 in the event of temporary power interruptions, such as if the device is dropped or the like. In the event that the batteries are removed and power is lost for a prolonged period, the 14 stage ripple carry counter U2 will reset and lose its count as the reset input RST is taken to ground through resistor R5.

Upon closure of power switch SW1, an oscillator comprising semiconductor devices Q2 and Q3 is enabled which provides the 14 stage ripple carry counter U2 with a series of pulses through clock input CK. As seen in the FIGURE, anytime power switch SWI is held closed, the 14 stage ripple carry counter U2 continues to increment its count stored therein. At such time that the count stored within the 14 stage ripple carry counter achieves a predetermined value, an output signal Q14 goes high, driving a light emitting diode LED thus alerting the operator that the length of time of use of the batteries comprising the power source BTl has exceeded a recommended value, typically 20 minutes. Since the above-described low battery indication circuit functions as a counter, and not as an actual evaluation of the batteries comprising the power source BTl, it must be agreed before hand by all using the device that, when replacing batteries, only new batteries will be used because the 14 stage ripple carry counter U2 loses its count upon removal of the batteries from the device. Thus, the 14 stage ripple carry counter U2, unaware of the quality of the replacement batteries, will by virtue of the reset input RST, start to count from a "zero" count anytime the batteries are removed and replaced.

The build-in shutoff feature of the present invention is shown in FIG. 5 and comprises a timer integrated circuit chip U1 of the type commonly referred to as "555 timer". As shown in the FIGURE, the integrated circuit chip timer U1 is arranged to operate in an a stable condition wherein upon closure of power switch SWI, power is applied to the chip U1 through input pins R and Vd. After a predetermined time period of approximately 15 seconds, the timer integrated circuit chip U1 operates to lower output signal Q to a low logic level, thus causing diode D7 to conduct whereby power transistor Q1 is forced into its nonconducting state. With the power transistor Q1 in its nonconducting state, the oscillator stage will not function and, thus the output circuit is rendered ineffective. A continuous closure of power switch SWl will act to maintain power to the timer integrated circuit chip U1 and after a predetermined time of approximately 5 seconds, the output Q is again returned to its original high logic state wherein diode D7 becomes reverse biased, thus re-enabling power transistor Q1.

Lastly, as shown in FIG. 5, the electrical diagrammatic representation of switch 30 is shown as SW2. Upon insertion of key 24 into housing 11, switch SW2 is opened as shown in the FIGURE. When the key 24 is removed from housing 11, switch SW2 closes thus tying the base of power transistor Q1 to ground. This, in effect, disables the relaxation oscillator and in turn disables the device.

Having thus described the invention, we claim:

1. An electrical circuit for a stun gun, the electrical circuit comprising:

a trigger switch operable in a first position and a second position;

a power source;

an inverter transformer comprising an inverter transformer primary winding and an inverter transformer secondary winding;

oscillator means, responsive to the first position of the trigger switch, for supplying energy from the power source to the inverter transformer primary winding;

an output stage circuit, coupled to the inverter transformer secondary winding, for generating a pulsed high voltage potential sufficient to ionize air across a gap;

low power source indicating means for indicating the trigger switch operated in the first position for a first predetermined time period;

defeat signal means for generating a defeat signal when a releasably connected key mechanism is disconnected from the stun gun;

first oscillator disabling means, responsive to the trigger switch operated in the first position for a second predetermined time period, for disabling the oscillator means; and, second oscillator disabling means, responsive to the defeat signal, for disabling the oscillator means.

2. The electrical circuit of claim 1 wherein the output stage circuit comprises:

an inert gas spark gap device in series with the inverter transformer secondary winding;

a rectifier in series with the inverter transformer secondary winding;

a storage capacitor in parallel with the inverter transformer secondary winding;

a bleeder resistor in parallel with the storage capacitor; and, an output transformer comprising an output transformer primary winding in series with the inverter transformer secondary winding and an output transformer secondary winding coupled to metallic probes forming the gap.

3. The electrical circuit of claim 1 wherein the low power source indicating means comprises:

a pulse generating means for generating pulses responsive to the trigger switch operated in the first position;

a counter means for counting the pulses, the counter means powered by the power source and generating a low power signal upon counting a predetermined number of pulses; and, an alerting means, responsive to the low power signal, for alerting the operator.

4. The electrical circuit of claim 3 wherein the low power source indicating means further comprises means for storing a charge, coupled to the counter means, to supply the counter means for a predetermined period of time with electrical power in an absence of the power source.

5. The electrical circuit of claim 1 wherein the first oscillator disabling means comprises timer circuit means, coupled to a power semiconductor device in the oscillator means, for generating an deactivation signal, the deactivation signal forcing the power semiconductor device to a nonconductive state thereby disabling the oscillator means.

6. The electrical circuit of claim 1 wherein the defeat signal means comprises a switch having a contact tied to a circuit ground, and wherein the second oscillator disabling means comprises a connection between a contact of the switch with a power semiconductor device in the oscillator means, the power semiconductor responsive to the defeat signal to enter a nonconductive state wherein the oscillator means is thereby disabled.

7. An electrical shock device comprising:

a housing containing a power supply and an electronic circuit forming the electrical shock device, the housing having an aperture;

trigger means on the housing for selectively connecting the power supply to the electronic circuit when in a first position;

low power source indicating means for indicating the trigger means operated in the first position for a first predetermined time period;

a key number means for enabling the electronic circuit when received into the aperture and for disabling the electronic circuit when not received into the aperture; and, securing means for securing the key member means to an operator.

8. The electrical shock device according to claim 7 wherein the key member means comprises a plug having at least one deformable barbed extension to matingly engage and interlock with the aperture and wherein the electronic circuit comprises a switch means for disabling the electronic circuit when the key member means is not matingly engaged and interlocked with the aperture.

9. An electrical circuit for use in a stun gun having a housing, probes on the housing separated by a gap and a key mechanism detachably connected to the housing, the electrical circuit comprising:

a trigger switch operable in a first position and a second position;

a power source;

an inverter transformer comprising an inverter transformer primary winding and an inverter transformer secondary winding;

oscillating means, responsive to the first position of the trigger switch, for supplying energy from the power source to the inverter transformer primary winding;

an output stage circuit, coupled to the inverter transformer secondary winding, for generating a pulsed high voltage potential across the probe gap; and, low power source indicating means for indicating the trigger switch operated in the first position for a first predetermined time period.

10. The electrical circuit according to claim 9 further comprising:

defeat signal means for generating a defeat signal when the detachably connected key mechanism is detached from the stun gun housing; and, first oscillator disabling means, responsive to the defeat signal, for disabling the oscillator means.

11. The electrical circuit according to claim 10 further comprising second oscillator disabling means, responsive to the trigger switch operated in the first position for a second predetermined time period, for disabling the oscillator means.

12. The electrical circuit according to claim 11 wherein the second oscillator disabling means comprises timer circuit means, coupled to a power semiconductor device in the oscillator means, for generating a deactivation signal, the deactivation signal forcing the power semiconductor device to a predetermined logical state disabling the oscillator means.

13. The electrical circuit according to claim 10 wherein the defeat signal means comprises a switch having a contact tied to a circuit ground, and wherein the first oscillator disabling means comprises a connection between a contact of the switch with a power semiconductor device in the defeat signal to enter a nonconductive state wherein the oscillator means is thereby disabled.

14. The electrical circuit according to claim 9 wherein the output stage circuit comprises:

an inert gas spark gap device in series with the inverter transformer secondary winding;

a rectifier in series with the inverter transformer secondary winding;

a storage capacitor in parallel with the inverter transformer secondary winding;

a bleeder resistor in parallel with the storage capacitor; and, an output transformer comprising an output transformer primary winding in series with the inverter transformer secondary winding and an output transformer secondary winding coupled to said probes.

15. The electrical circuit according to claim 9 wherein the low power source indicating means comprises:

a pulse generating means for generating pulses responsive to the trigger switch operated in the first position;

a counter means for counting the pulses, the counter means powered by the power source and generating a low power signal upon counting a predetermined number of pulses; and, an alerting means, responsive to the low power signal, for alerting the operator.

16. The electrical circuit according to claim 15 wherein the low power source indicating means further comprises means for storing a charge, coupled to the counter means, to supply the counter means for a predetermined period of time with electrical power in an absence of the power source.

17. The electrical circuit according to claim 9 further comprising second oscillator disabling means, responsive to the trigger switch operated in the first position for a second predetermined time period, for disabling the oscillator means.

18. An electric shock device comprising:

a housing;

a trigger switch on the housing operable in a first position and a second position;

a key member adapted for selective engagement with the housing;

an electronic circuit contained within the housing responsive to the key member engaged with the housing to generate an electric charge, the circuit comprising:

a power source;

an inverter transformer comprising an inverter transformer primary winding and an inverter transformer secondary winding;

oscillator means, responsive to the trigger switch in the first position, for supplying energy from the power source to the inverter transformer primary winding;

an output stage circuit, coupled to the inverter transformer secondary winding, for generating a pulses high voltage potential across said pair of contact probes;

low power source indicating means for indicating the trigger switch operated in the first position for a first predetermined time period;

defeat signal means for generating a defeat signal when said key member is disengaged from said housing;

first oscillator disabling means, responsive to the trigger switch operated in the first position for a second predetermined time period, for disabling the oscillator means; and, second oscillator disabling means, responsive to the defeat signal, for disabling the oscillator means;

a pair of contact probes on the housing for administering the electric charge generated by the electronic circuit; and, attaching means for fixedly attaching the key member to an operator, the key member and the attaching means remaining with the operator to disable the electronic circuit when the key number is disengaged from the housing.

19. The electric shock device according to claim 18 wherein the output stage circuit comprises:

an inert gas spark gap device in series with the inverter transformer secondary winding;

a rectifier in series with the inverter transformer secondary winding;

a storage capacitor in parallel with the inverter transformer secondary winding;

a bleeder resistor in parallel with the storage capacitor; and, an output transformer comprising an output transformer primary winding in series with the inverter transformer secondary winding and an output transformer secondary winding coupled to said pair of contact probes.

20. The electric shock device according to claim 18 wherein the low power source indicating means comprises:

a pulse generating means for generating pulses responsive to the trigger switch operated in the first position;

a counter means for counting the pulses, the counter means powered by the power source and generating a low power signal upon counting a predetermined number of pulses; and, an alerting means, responsive to the low power signal, for alerting said operator.

21. The electric shock device according to claim 20 wherein the low power source indicating means further comprises means for storing a charge, coupled to the counter means, to supply the counter means for a predetermined period of time with electrical power in an absence of the power source.

22. The electric shock device according to claim 18 wherein the first oscillator disabling means comprises timer circuit means, coupled to a power semiconductor device in the oscillator means, for generating a deactivation signal, the deactivation signal forcing the power semiconductor device to a nonconductive state thereby disabling the oscillator means.

23. The electric shock device according to claim 18 wherein the defeat signal means comprises a switch having a contact tied to a circuit ground, and wherein the second oscillator disabling means comprises a connection between a contact of the switch with a power semiconductor device in the oscillator means, the power semiconductor responsive to the defeat signal to enter a nonconductive state wherein the oscillator means is thereby disabled.

24. An electric shock device comprising:

a housing;

a key member adapted for selective engagement with the housing;

an electronic circuit contained within the housing responsive to the key member engaged with the housing to generate an electric charge, said electronic circuit comprising:

a trigger switch operable in a first position and a second position;

a power source;

an inverter transformer comprising an inverter transformer primary winding and an inverter transformer secondary winding;

oscillator means, responsive to the first position of the trigger switch, for supplying energy from the power source to the inverter transformer primary winding;

an output stage circuit, coupled to the inverter transformer secondary winding, for generating a pulsed high voltage potential across a pair of contact probes on the housing for administering the electric charge generated by the electronic circuit; and, low power source indicating means for indicating the trigger switch operated in the first position for a first predetermined time period; and, attaching means for fixedly attaching the key member to an operator, the key member and the attaching means remaining with the operator to disable the electronic circuit when the key member is disengaged from the housing.

25. The electric shock device according to claim 24 further comprising:

defeat signal means for generating a defeat signal when said key member is detached from said housing; and, first oscillator disabling means, responsive to the defeat signal, for disabling the oscillator means.

26. The electric shock device according to claim 25 further comprising second oscillator disabling means, responsive to the trigger switch operated in the first position for a second predetermined time period, for disabling the oscillator means.

27. The electric shock device according to claim 26 wherein the second oscillator disabling means comprises timer circuit means, coupled to a power semiconductor device in the oscillator means, for generating a deactivation signal, the deactivation signal forcing the power semiconductor device to a predetermined logical state disabling the oscillator means.

28. The electric shock device according to claim 25 wherein the defeat signal means comprises a switch having a contact tired to a circuit ground, and wherein the first oscillator disabling means comprises a connection between a contact of the switch with a power semiconductor device to the oscillator means, the power semiconductor responsive to the defeat signal to enter a nonconductive state wherein the oscillator means is thereby disabled.

29. The electric shock device according to claim 24 wherein the output state circuit comprises:

an inert gas spark gap device in series with the inverter transformer secondary winding;

a rectifier in series with the inverter transformer secondary winding;

a storage capacitor in parallel with the inverter transformer secondary winding;

a bleeder resistor in parallel with the storage capacitor; and, an output transformer comprising an output transformer primary winding in series with the inverter transformer secondary winding and an output transformer secondary winding coupled to said pair of contact probes.

30. The electric shock device according to claim 29 wherein the low power source indicating means comprises:

a pulse generating means for generating pulses responsive to the trigger switch operated in the first position;

a counter means for counting the pulses, the counter means powered by the power source and generating a low power signal upon counting a predetermined number of pulses; and, an alerting means, responsive to the low power signal, for alerting said operator.

31. The electric shock device according to claim 30 wherein the low power source indicating means further comprises means for storing a charge, coupled to the counter means, to supply the counter means for a predetermined period of time with electrical power in an absence of the power source.

32. The electric shock device according to claim 24 further comprising second oscillator disabling means, responsive to the trigger switch operated in the first position for a second predetermined time period, for disabling the oscillator means.

33. An electrical shock device comprising:

a housing containing a power supply and an electronic circuit having the electrical shock device;

trigger means on the housing for selectively connecting the power supply to the electric circuit when in a first position; and, low power source indicating means for indicating the trigger means operated in the first position for a first predetermined time period.

34. The electrical shock device according to claim 33 further comprising:

key member means for enabling the electronic circuit when received into an aperture in the housing and for disabling the electronic circuit when not received into the aperture; and, securing means for securing the key member means to an operator.

35. The electrical shock device according to claim 33 wherein the key member means comprises a plug having at least one deformable barbed extension to matingly engage and interlock with the aperture and wherein the electronic circuit comprises a switch means for disabling the electronic circuit when the key member means is not matingly engaged and interlocked with the aperture.

36. The electrical shock device according to claim 33 further comprising means for disabling the electronic circuit when the trigger means is continuously operated in said first position for a second predetermined time period.

37. The electrical shock device according to claim 36 further comprising:

key member means for enabling the electronic circuit when received into an aperture in the housing and for disabling the electronic circuit when not received into the aperture; and, securing means for securing the key member means to an operator.

38. The electrical shock device according to claim 37 wherein the key member means comprises a plug having at least one deformable barbed extension to matingly engage and interlock with the aperture and wherein the electronic circuit comprises a switch means for disabling the electronic circuit when the key member means is not matingly engaged and interlocked with the aperture.

39. An electrical shock device comprising:

a housing containing a power supply and an electronic circuit forming the electrical shock device;

trigger means on the housing for selectively connecting the power supply to the electronic circuit when in a first position; and, means for disabling the electronic circuit when the trigger means is continuously operated in said first position for a first predetermined time period.

40. The electrical shock device according to claim 39 further comprising:

low power source indicating means for indicating the trigger means operated in the first position for a second predetermined time period.

41. The electrical shock device according to claim 39 further comprising:

key member means for enabling the electronic circuit when received into an aperture in said housing and for disabling the electronic circuit when not received into the aperture; and, securing means for securing the key member means to an operator.

42. The electrical shock device according to claim 41 wherein the key member means comprises a plug having at least one deformable barbed extension to matingly engage and interlock with the aperture and wherein the electronic circuit comprises a switch means for disabling the electronic circuit when the key member means is not matingly engaged and interlocked with the aperture.

* * * * *